US007204193B2

(12) United States Patent
Scherrer et al.

(10) Patent No.: US 7,204,193 B2
(45) Date of Patent: Apr. 17, 2007

(54) HOLDING APPARATUS, WHICH CAN BE PLACED ON A TABLE AND IS ALSO MOBILE, FOR A WORK AID

(75) Inventors: Ernst Scherrer, Greifensee (CH); Peter Meier, Fehraltorf (CH)

(73) Assignee: INOTOP AG, Tagelswangen (CH)

( * ) Notice: Subject to any disclaimer, the term of this patent is extended or adjusted under 35 U.S.C. 154(b) by 177 days.

(21) Appl. No.: 10/844,831

(22) Filed: May 13, 2004

(65) Prior Publication Data

US 2004/0226485 A1 Nov. 18, 2004

(30) Foreign Application Priority Data

May 13, 2003 (CH) ..... 2003 0833/03

(51) Int. Cl.
*A47B 23/00* (2006.01)

(52) U.S. Cl. ..... 108/43; 108/147

(58) Field of Classification Search ..... 108/43, 108/147, 107, 49, 34, 35, 38; 248/444, 449, 248/404, 161, 162.1
See application file for complete search history.

(56) References Cited

U.S. PATENT DOCUMENTS 1,653,657 A * 12/1927 Pretsch ..... 108/49
4,292,748 A * 10/1981 Miller ..... 108/43
5,144,898 A * 9/1992 Posly ..... 108/49
5,265,541 A * 11/1993 Gordon ..... 108/34
5,359,741 A * 11/1994 Lang ..... 108/49
6,027,092 A * 2/2000 Gordon ..... 248/444
6,042,065 A * 3/2000 Benjamin ..... 248/449
6,044,758 A * 4/2000 Drake ..... 108/43
6,098,952 A * 8/2000 Tonn ..... 248/455
6,152,417 A * 11/2000 Randall ..... 108/43
6,353,530 B1 * 3/2002 Zarek et al. ..... 108/43
6,470,809 B1 * 10/2002 Herbert ..... 108/44
6,553,918 B2 * 4/2003 Bieza ..... 108/43
6,584,913 B2 * 7/2003 Cloud ..... 108/43
2002/0066630 A1 6/2002 Brown, Sr.

FOREIGN PATENT DOCUMENTS

FR 2660535 A1 * 10/1991
WO WO 02/13653 A1 12/2000

* cited by examiner

*Primary Examiner*—Jose V. Chen
(74) *Attorney, Agent, or Firm*—The Webb Law Firm

(57) ABSTRACT

The mobile holding apparatus has a support plate which has an upper side with a work surface and a lower side and is mounted height-adjustably on a stand. The stand is free-standing and the support plate has a guide with which it is guided on the stand. A gas spring arranged in the stand supports the upward movement of the support plate. Loading of the support plate is taken up by self-locking of the guide and in particular by canting of a profiled piece in a guide groove. The holding apparatus makes possible ergonomic positioning of a work aid, for example a laptop.

7 Claims, 6 Drawing Sheets

HOLDING APPARATUS, WHICH CAN BE PLACED ON A TABLE AND IS ALSO MOBILE, FOR A WORK AID

BACKGROUND OF THE INVENTION

1. Field of the Invention

The invention relates to a holding apparatus, which can be placed on a table and is also mobile, for a work aid, in particular for a laptop, a flat screen or a keyboard, with a support plate which has an upper side with a work surface and a lower side and is mounted on a stand.

2. Description of the Related Art

In the prior art, numerous holding devices for laptops or notebooks have already become known, which are portable and are intended to make ergonomic working at a desk possible. In U.S. Pat. No. 6,098,952, for example, a holding device is proposed, which has a support plate which has on its underside a plurality of projections at which the support plate can be supported on a table edge. At the rear edge, the support plate is supported with a footplate. This footplate is pivotable and adjustable, so that different inclinations of the support plate/the laptop can be set. It is a disadvantage of this holding device that the height itself cannot be adjusted, which would nevertheless be desirable for ergonomic and in particular health-related reasons. Moreover, a table edge suitable for support is not always available.

A holding device which has a three-legged stand is known from U.S. Pat. No. 2002/0066630. As is customary, the stand is telescopically adjustable, so that the height too of the work device can be adjusted in the case of this holding device. However, it is scarcely possible for this holding device to be used on a table.

A collapsible platform for a laptop, which is supported on a horizontally extending arm, is known from WO 02/13659. Height-adjustment is scarcely possible with this holding device.

Finally, U.S. Pat. No. 6,470,809 discloses a holding device which can be mounted in a vehicle and has a platform fastened on a vertical stand. Height-adjustability is not possible in this case either.

SUMMARY OF THE INVENTION

It is therefore the object of the invention to produce a holding apparatus of said kind, which is more suitable as an ergonomic aid in particular for daily office work and can nevertheless be manufactured cost-effectively.

In a holding apparatus of the generic type, the object is achieved by virtue of the fact that the stand is free-standing and the support plate has guide means with which it is guided height-adjustably on the stand. The holding apparatus according to the invention is free-standing and can thus be arranged in the desired position on any table. Owing to the height-adjustability, it is possible to use the work aid both while sitting and while standing. As a result, strain on the back can be greatly reduced, and, because of the different possible postures, the back muscles can moreover be strengthened. The continuous height-adjustability on the stand also makes it possible to achieve a lower position which is, for example, only 15 mm above the work surface of the desk.

According to a development of the invention, the support plate has guide elements, on which the work plate is continuously height-adjustable by means of linear guidance. Particularly simple and rapid height adjustment is achieved if, according to a development of the invention, the positioning of the support plate in any position is effected by self-locking of the guide elements.

Particularly simple and convenient manual adjustability is guaranteed if, according to a development of the invention, the support plate is, for weight counterbalance, supported with a gas spring. Comparatively heavy work aids can thus also be used. The height-adjustability is nevertheless simple. The gas spring serves moreover as a safeguard against unintentional lowering of the support plate, should the self-locking of the guide elements be discontinued.

The holding apparatus according to the invention is suitable in particular for notebooks or laptops and flat screens with a keyboard in offices. In principle, however, other work aids can also be ergonomically positioned with the holding apparatus according to the invention.

Further advantageous features emerge from the dependent patent claims, the description below and also the claims.

BRIEF DESCRIPTION OF THE DRAWINGS

An illustrative embodiment of the invention is explained in greater detail below with reference to the drawings, in which.

DESCRIPTION OF THE PREFERRED EMBODIMENTS

Figure 1:
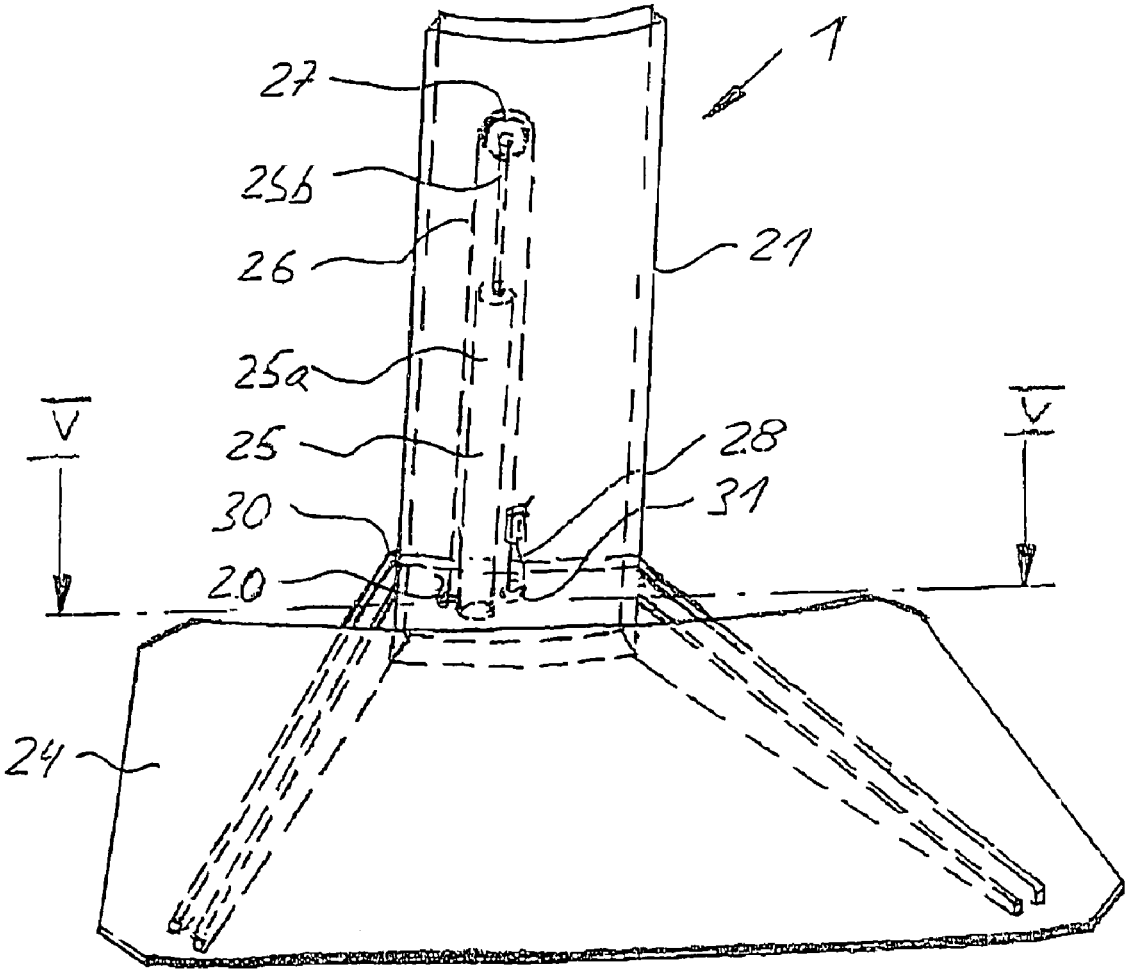
FIG. 1 shows diagrammatically a three-dimensional view of a holding apparatus according to the invention.
Figure 2:
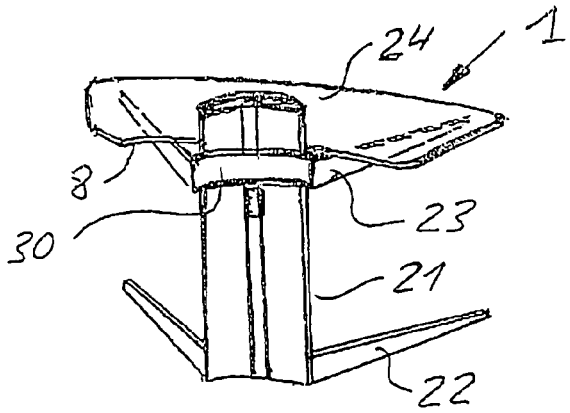
FIG. 2 shows a three-dimensional view from the rear side of the holding apparatus according to FIG. 1.
Figure 3:
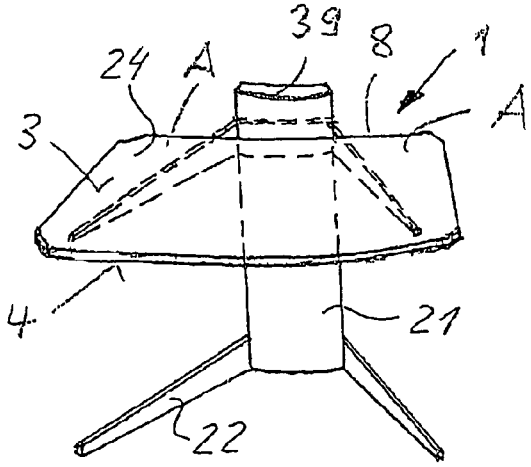
FIG. 3 shows a three-dimensional view of the holding apparatus according to the invention, the support plate being arranged in an upper position.
Figure 4:
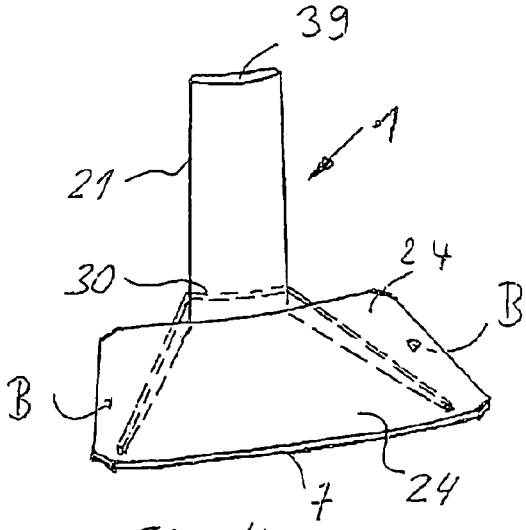
FIG. 4 shows diagrammatically a three-dimensional view of the holding apparatus according to FIG. 1, the support plate being arranged in the lowest position.
Figure 5:
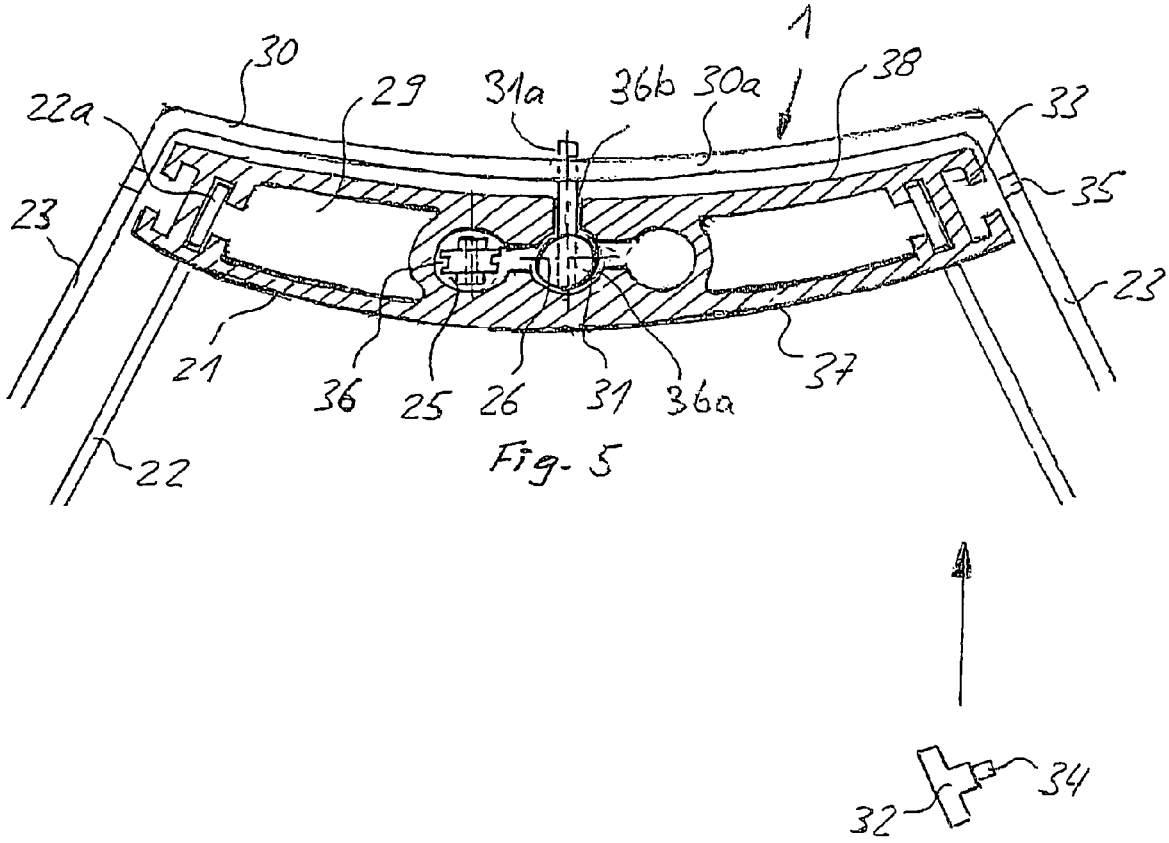
FIG. 5 shows a section through the holding apparatus along the line V—V in FIG. 1.
Figure 6:
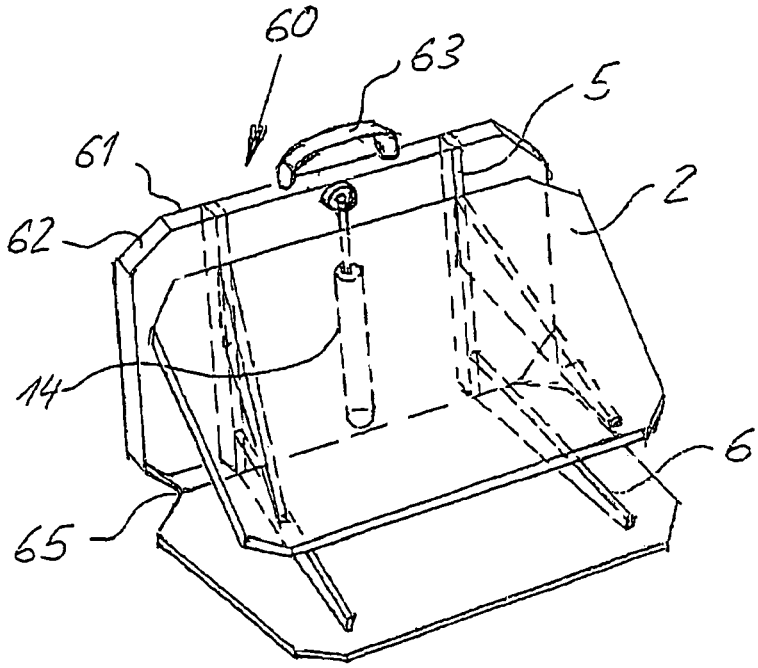
FIG. 6 shows a further three-dimensional view of the holding apparatus according to a variant and of a container in an open state.

The holding apparatus 1 shown in FIGS. 1 to 5 has a support plate 24 on which, for example, a laptop, a flat screen or a keyboard can be placed. The support plate 24 rests on two arms 23 which protrude at an angle to one another and are mounted on a slide 30 which is continuously height-adjustable on a stand 21. According to FIG. 3, the support plate 24 has an upper side 3 and a lower side 4. The stand 21 is a plate-shaped profiled part made of, for example, aluminum and has, according to FIG. 9, a convex front side 37 and a slightly concave rear side 38. For reasons of weight and stability, the stand 21 has at least one cavity 29 which extends essentially over the entire height of the stand 21. In each of the arms 23, the slide 30 has a bore 35, in each of which bores a pin 34, shown separately in FIG. 5, of a profiled piece 32 engages. The two profiled pieces 32 are in each case guided in a slidable and self-locking manner in a channel 33 of the stand 21 arranged on a narrow side of the stand 21 and connect the slide 30 to the stand 21.

The slide 30 and the profiled pieces 32 form guide means for the support plate 24. The slide can be height-adjusted by hand on the support plate 24. The height set is fixed downwardly by loading or by dead weight. Fixing is effected by the two profiled pieces 32 which are each canted in the corresponding channel 33, resulting in frictional locking.

Arranged inside the stand 21 is a duct 36 in which a gas spring 25 is arranged. This gas spring 25 has a housing 25*a* in which an extendable piston 25*b* is mounted. Mounted at the front end of the piston 25*b* is a deflection roller 27 on which a cable pull 26 is deflected. This cable pull 26 is connected at one end 20 to the stand 21 and at the other end 28 to a driver 31. The gas spring 25 supports an upward movement of the driver 31 and thus of the support plate 24.

The cable pull 26 makes such support possible essentially over the entire height of the stand 21. The gas spring 25 holds the support plate 24 even if the self-locking of the profiled pieces 32 should be inadequate or discontinued. The driver 31 is guided slidably in a central part 36*a* of the duct 36 and has a projection 31*a* which projects rearwardly at the rear side 38 through a slit 36*b*. The slide 30 lies loosely on this projection 31*a*. In order to move the support plate 24 downward, downward pressure is applied with the hands to the upper side 3 at the locations A, and thus at the rear edge 8 of the support plate 24 (see FIG. 3). In order to move the support plate 24 upward, the hands pull upward at the locations B on the lower side 4 or at a front edge 7 (see FIG. 4). In the position of the support plate 24 shown in FIG. 4, it lies on the feet 22 and preferably with the edge 7 on the table (not shown here), so that the support plate 24 is supported especially stably by lying like this and can be correspondingly loaded.

The stand 21 rests on two feet 22 which are each at an inner end 22*a* (FIG. 5) inserted loosely into the stand 21 from below. For transport, these legs 22 can be removed from the stand 21. In this respect, an embodiment in which the legs 22 are articulated pivotably or foldably on the stand 21 is also conceivable. The slide 30 has a rear wall 30*a* which, according to FIG. 9, runs parallel to the rear side 38 and extends between the two arms 23. The driver 31 bears against the wall 30*a* from below. This results in great stability, which makes possible the use of comparatively heavy work devices as well. Owing to the support by the gas spring 25, such devices can also be adjusted linearly and continuously over the entire height of the stand 21. It is thus possible in a simple manner in each case to set the suitable and ergonomically most favorable position of the support plate 24 continuously. The slide 30 can be removed upwardly from the stand 21, it being necessary for a cover 39 (FIG. 3) to be taken off. The slide 30 with the support plate 24 and the two feet 22 and the stand 21 too can consequently be separated from one another and transported as individual parts. This makes compact transport possible. Assembly is very simple. For this, the slide 30 is mounted on the stand 21 from above, the profiled pieces 32 being pushed into the respective channel 33. The two feet 22 are inserted or engaged in the corresponding openings of the stand 21. Finally, the cover 39 is mounted on the upper end of the stand 21.

Figure 7:
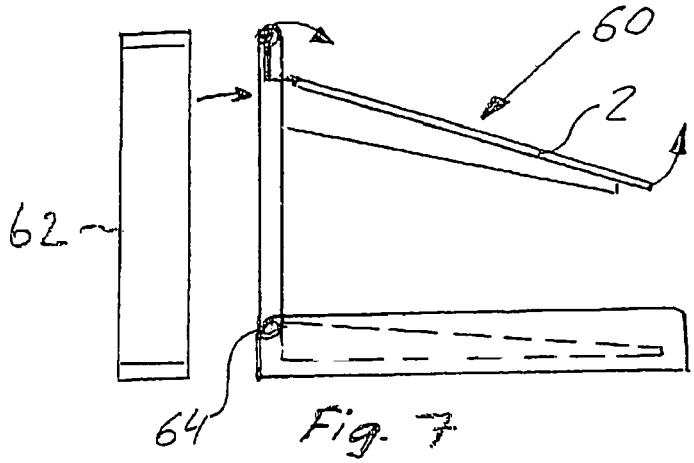
FIG. 7 shows a further lateral view of the holding apparatus according to the invention with container according to FIG. 6.
Figure 8:
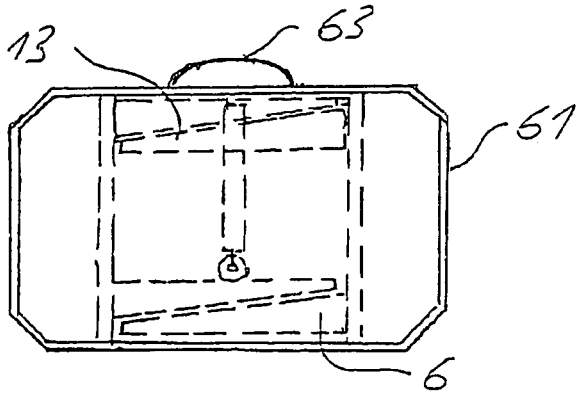
FIG. 8 shows diagrammatically a three-dimensional view of the holding apparatus according to FIG. 6, the device being accommodated in the container.
Figure 9:
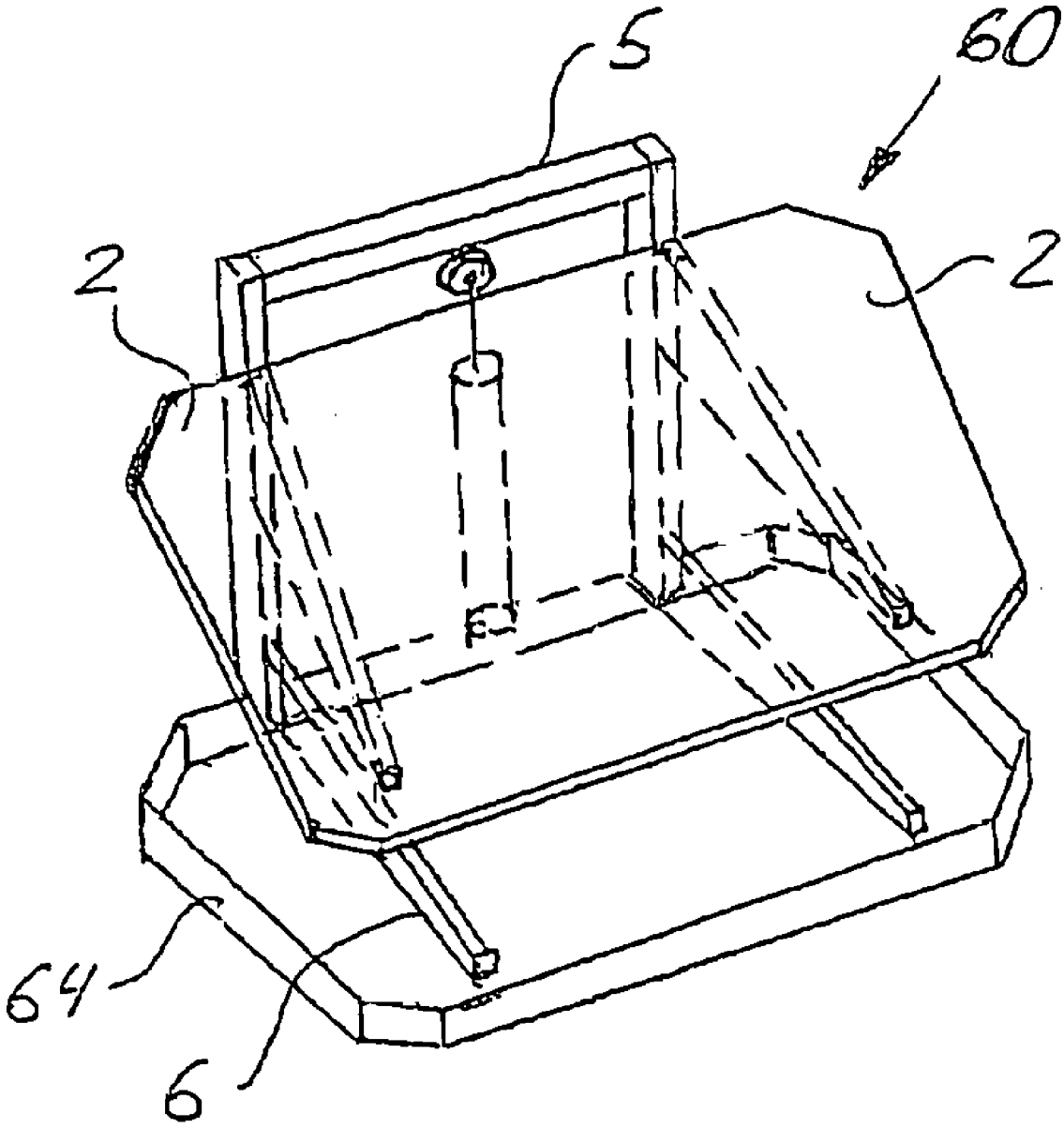
FIG. 9 shows a further three-dimensional view of the holding apparatus according to FIG. 6.

The holding apparatus 60 shown in FIGS. 6 to 9 has a case-shaped container 61 which has a lid 62 with a handle 63 and also a bottom 64. The bottom 64 is connected to the lid 62 via a hinge 65. The lid 62 is designed in such a way that it can receive the stand 5 mentioned above, as FIG. 6 in particular shows. The support plate 2 is designed in such a way that it can be accommodated in the bottom 64 or in the lid 62. Feet 6 and arms 13 can be folded in, as illustrated in FIG. 8. The container 61 is comparatively narrow and can receive all the other parts. The work position is shown in FIGS. 7 and 9. Here, the bottom 64 can serve as a support and to receive other devices. The height-adjustment of the plate 2 can be effected as explained above, a gas spring 14 also being provided here. The holding apparatus 60 is suitable in particular for mobile use, as the individual parts can be accommodated simply and rapidly in the container 61 and returned to the work position just as simply.

Figure 10:
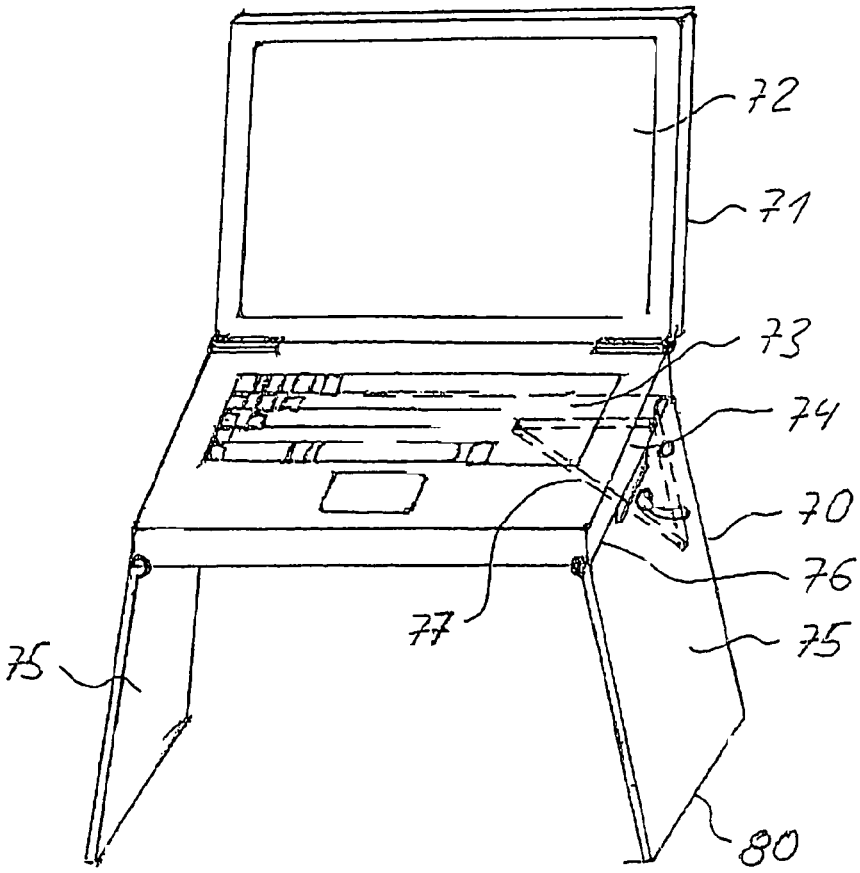
FIG. 10 shows diagrammatically a three-dimensional view of a further variant of the holding apparatus according to the invention.
Figure 11:
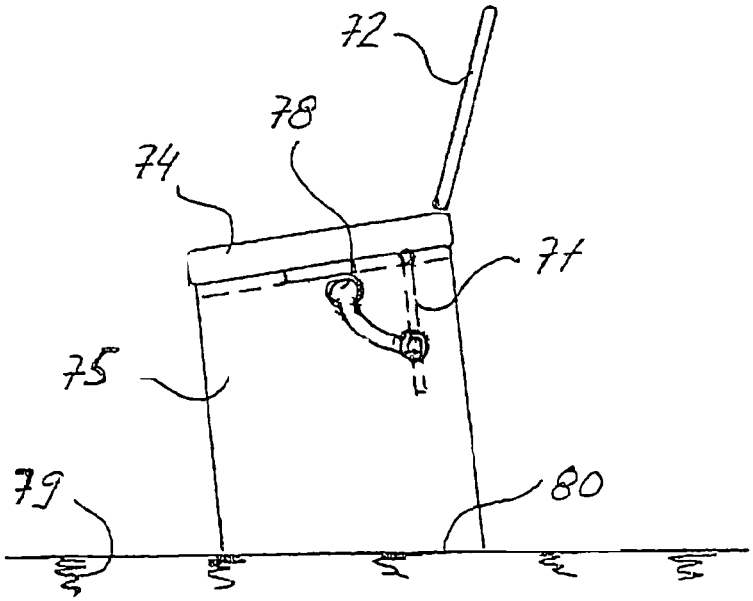
FIG. 11 shows a further view of the holding apparatus according to FIG. 10.

FIGS. 10 and 11 show a holding apparatus 70 which is integrated in the bottom of a device, in particular of an electronic device, for example of a laptop 70, or is fastened detachably, in particular latchably, to the bottom of the device. The holding apparatus 70 is suitable in particular for what is known as a tablet PC, which can be latched detachably onto the holding apparatus 70. In a conventional way, this electronic device 41 has a flat screen 72 and a keyboard 73 which is arranged in a housing 74. Arranged on the lower side of the housing 74 are two legs 75 which are articulated laterally on the housing 74 in each case via a hinge 76. In the folded-out position shown, the legs 75 are in each case fixed with a strut 77 which is fastened at one end to a leg 75 and at the other end to the lower side of the housing 74. The fixing of the struts 77 to the legs 75 is effected in each case with a groove 78 shown in FIG. 17, in which the struts can in each case be run in and out. In the run-out position, the legs 75 are free and can be folded in, so that they are each parallel to the lower side of the housing 74. The legs 75 each have a lower edge 80 which, according to FIG. 17, can run at an angle to the lower side of the housing 74, so that the device 71 placed on a table 79 occupies an ergonomically advantageous position. In principle, the legs 75 can be extendable telescopically or in any way, so that in addition the height of the housing 74 above the upper side of the table 79 can be adjusted as well. In the folded-in position, the legs 75 lie flat against the lower side of the housing 74. As a result, the holding apparatus 70 is consequently especially compact and can be handled very easily. Moreover, the additional weight for the device 41 can be kept very low, especially if the legs 75 and the struts 77 are manufactured from a suitable metal, for example from aluminum.

The invention claimed is:

1. A mobile holding apparatus for a work aid, wherein the holding apparatus is comprised of a support plate, wherein the support plate includes an upper side with a work surface and a lower side, further wherein the support plate is mounted on a stand, wherein the stand is free-standing and the support plate includes guide means for adjusting the height of the support plate on the stand, wherein a slide is height-adjustably mounted on the stand, wherein the support plate is guided with said slide in a self-locking manner on the stand and downwardly supported with a gas spring, wherein the gas spring acts on the slide from below and wherein the support plate is mounted on the stand in such a way that the support plate can be moved downward by hand in a rear region and upward by hand in a front region, the slide includes two guide elements arranged a distance from one another, the guide elements are each guided in a self-locking manner in a groove and fixing is effected by the elements, which are canted in a corresponding channel, resulting in frictional locking.

2. The holding apparatus as claimed in claim 1, wherein the guide elements are each fastened to a respective arm and the support plate is supported on the arms.

3. The holding apparatus as claimed in claim 1, wherein the guide elements are each fastened to a respective arm and the support plate is supported on the arms.

4. The holding apparatus as claimed in claim 1, wherein the support plate is supported on two arms projecting away from the stand.

5. The holding apparatus as claimed in claim 1, wherein two feet projecting away from the holding apparatus are fastened to the stand.

6. The holding apparatus as claimed in claim 5, wherein one of the arms and the feet are removably articulated on the stand.

7. The holding apparatus as claimed in claim 1, further comprising a case-shaped container having a bottom and a lid, wherein the lid forms a receptacle and is configured to receive the support plate and the stand within the receptacle.

* * * * *